US005101551A

United States Patent [19]

Rademacher et al.

[11] Patent Number: 5,101,551

[45] Date of Patent: Apr. 7, 1992

[54] GAPPING SYSTEM FOR SLIDE-FASTENER MANUFACTURE

[75] Inventors: Werner Rademacher, Essen-Kettwig; Franz Hochlehnert, Essen; Jörg Geiger, Oberhausen; Reinhard Damaschke, Essen; Klaus Buschmann, Gelsenkirchen, all of Fed. Rep. of Germany

[73] Assignee: Opti Patent-, Forschungs- Und Fabrikations-AG, Riedern-Allmeind, Switzerland

[21] Appl. No.: 632,379

[22] Filed: Dec. 24, 1990

Related U.S. Application Data

[63] Continuation-in-part of Ser. No. 387,295, Jul. 28, 1989, abandoned.

[30] Foreign Application Priority Data

Jul. 28, 1988 [DE] Fed. Rep. of Germany ..... 3825714
Oct. 27, 1990 [DE] Fed. Rep. of Germany ..... 4034275

[51] Int. Cl.[5] ..... A41H 37/06

[52] U.S. Cl. ..... 29/766; 29/408; 29/33.2; 83/371; 83/921

[58] Field of Search ..... 29/32.2, 34 A, 766, 29/410, 408; 83/371, 921

[56] References Cited

U.S. PATENT DOCUMENTS 4,310,961 1/1982 Clearwater ..... 29/408
4,520,544 6/1985 Morita et al. ..... 29/408
4,625,375 12/1986 Osaki ..... 29/408 X
5,020,206 6/1991 Yoshida et al. ..... 29/408

*Primary Examiner*—Joseph M. Gorski
*Assistant Examiner*—S. Thomas Hughes
*Attorney, Agent, or Firm*—Herbert Dubno; Andrew Wilford

[57] ABSTRACT

A slide-fastener stringer is pulled through a gapping station by a motor operatively engaging the stringer without slip and at least one feed roller engaging the stringer upstream of the gapping station. A storage unit downstream of the feed roller and upstream of the gapping station loops the stringer upstream of the station in a variable-size loop and has a rotatable and movable buffer roller over which the stringer passes and a pair of rotatable but nonmoving buffer rollers flanking the movable buffer roller. The movable roller is urged away from the flanking rollers with a force sufficient to tension the stringer. The drive of the feed roller is operated in accordance with the position of the movable buffer roller for stretching the stringer between the buffer rollers by at most 1%. A gapper at the station periodically clamps and longitudinally arrests the stringer and then cuts the coupling elements therefrom at the station. A sensor roller physically engaging the stringer between the station and the loop detects and measures the displacement of the stringer after each clamping and cutting of the stringer at the station and generates an actual-value output corresponding thereto that is compared with a set point corresponding to a desired slide-fastener length after each clamping and the stringer is longitudinally advanced after each clamping and cutting of the stringer only until the actual-value output matches the set point.

8 Claims, 2 Drawing Sheets

GAPPING SYSTEM FOR SLIDE-FASTENER MANUFACTURE

CROSS REFERENCE TO RELATED APPLICATION

This application is a continuation-in-part of our copending patent application 07/387,295 filed 28 Jul. 1989 and now abandoned.

FIELD OF THE INVENTION

The present invention relates to an apparatus for making a slide fastener. More particularly this invention concerns such an apparatus for forming gaps in a workpiece used to make a slide fastener.

BACKGROUND OF THE INVENTION

A slide fastener typically is formed by a pair of longitudinally extending and parallel textile tapes having confronting edges that carry interleavable coupling elements. These elements, which are typically made of a synthetic-resin coiled or meandered monofilament, do not extend the full length of the respective tapes and are joined together at their one ends by a so-called bottom end stop and each carry at their opposite ends a so-called top stop. A slide can move along both elements and is constructed such that on longitudinal movement from the bottom stop toward the top stops it interleaves, that is joins, the two coupling elements, and on opposite movement it separates them.

Such fasteners are typically made as described in commonly assigned U.S. Pat. No. 4,932,113 in a mass-production operation starting from a basic workpiece comprised of two very long parallel tapes whose confronting edges carry full-length coupling elements that are usually joined together. In a first machine a gap is formed in the joined coupling elements, same being cut away or otherwise removed for short distances at locations spaced along the tapes by the length of the fasteners to be made. Then the bottom end stops are fitted to the joined coupling elements at what is normally relative to the direction of travel of the tapes the trailing edge of each gap. A slider is then fitted to the elements from the leading edge of each gap, being slid on in a direction tending to separate the elements. Subsequently the top stops are applied to the separated coupling elements immediately downstream of the slider at the leading end of each gap. Finally the tapes are cut transversely across generally through the center of the gap, separating out the individual fasteners.

The gapping machine typically comprises a transport system that pulls the workpiece through a guide provided at its upstream end with a clamp and, immediately downstream therefrom, a punch and die system or the like that serves to cut out the coupling elements. As a rule the transport system is a pair of continuously driven pinch rollers frictionally engaging the workpiece with sufficient force to advance it through the machine, which offers substantial resistance to advance of the workpiece. The clamp is closed periodically to arrest the workpiece, whereupon the cutter itself works. During the time the clamp is closed the workpiece slips between the pinch rollers.

Such an arrangement has two main problems. First of all the spacing of the gaps is not very exact. The clamp is operated at a rate dependent of the peripheral speed of the transport rollers, so that it closes at exactly spaced intervals. Unfortunately the stop-and-go nature of the operation plus the varying friction between the workpiece on one side and the clamp and rollers on the other adds some range for error to the actual spacing of the gaps, as any slippage as the tape starts and/or stops is translated into a placement error.

Second, the transport rollers continue to rotate even when the workpiece is stationarily clamped upstream, so that considerable tension is created in the workpiece. Depending on the coefficients of friction of the rollers and workpiece, the longitudinal stretchability of the workpiece, and the force with which the rollers are urged together, this can translate into a tension that is so great that a gap is formed that, once the workpiece is released, shortens. Thus in general the known system is inexact, and this inexactitude is particularly troublesome in automatic systems that sense the gap itself to trigger other manufacturing steps, like installing the end stops and slider.

In the above-cited parent application we disclose a method of forming longitudinally spaced gaps in a workpiece formed of a pair of longitudinally extending parallel tapes having confronting edges provided with longitudinally extending and transversely couplable coupling elements. This method comprises the steps of guiding the workpiece longitudinally through a gapping station, looping the workpiece upstream of the station in a variable-size loop, continuously pinching the workpiece downstream of the station between a pair of transport rollers without the possibility of substantial slippage between the transport rollers and the workpiece, and periodically clamping and longitudinally arresting the workpiece at the station and cutting the coupling elements therefrom at the station to form a gap in the workpiece. In accordance with this earlier invention the displacement of the workpiece between the loop and the station is detected and measured after each clamping and cutting of the workpiece at the station and an output is generated corresponding to this displacement. This output is in turn compared with a set point corresponding to a desired slide-fastener length after each clamping and cutting of the workpiece at the station and the rollers are rotated to longitudinally advance the workpiece after each clamping and cutting of the workpiece only until the actual-value output matches the set point.

Thus according to our earlier invention the workpiece is positively fed through the gapping machine by the desired length in an arrangement where there is no slippage Instead of accommodating a continuously arriving workpiece by allowing slippage during the gapping operation at the transport system, the excess arriving workpiece is taken up at the looper. The result is extremely accurate gapping of the workpiece.

SUMMARY OF THE INVENTION

Longitudinally spaced gaps are cut in a workpiece formed of a pair of longitudinally extending parallel tapes having confronting edges provided with longitudinally extending and transversely couplable coupling elements. This is done by an apparatus having a transport system including a stepping motor operatively engaging the workpiece without slip for pulling the workpiece longitudinally through a gapping station, and at least one feed roller and its respective drive engaging the workpiece upstream of the gapping station for advancing the workpiece downstream toward the gapping station. A storage unit downstream of the feed roller and upstream of the gapping station loops the workpiece upstream of the station in a variable-size loop. This storage unit has a rotatable and movable buffer roller over which the workpiece passes and a pair of rotatable but nonmoving buffer rollers flanking the movable buffer roller. The loop is formed around the buffer roller which itself is urged away from the flanking rollers with a force sufficient to tension the workpiece. An output is formed corresponding to the position of the movable buffer roller relative to the nonmoving buffer rollers and the drive of the feed roller is operated in accordance with the output for stretching the workpiece between the buffer rollers by at most 1%, by which is meant its length is increased by no more than the stated percentage from its length when not under any tension. A gapper at the station periodically clamps and longitudinally arrests the workpiece and then cuts the coupling elements therefrom at the station to form a gap in the workpiece. A sensor roller physically engaging the workpiece between the station and the loop detects and measures the displacement of the workpiece after each clamping and cutting of the workpiece at the station and generates an actual-value output corresponding thereto. The actual-value output is compared with a set point corresponding to a desired slide-fastener length after each clamping and the workpiece is longitudinally advanced after each clamping and cutting of the workpiece only until the actual-value output matches the set point.

According to this invention the set point is adjustable so that different fastener lengths can be set in the control means. Furthermore the output of the buffer-roller position is determined by a potentiometer.

The sensor roller according to this invention can engage the tapes and provides an output corresponding to the length of tape passing the sensor roller or it can engage at least one of the coupling elements to provide an output corresponding to the length of the coupling element passing the sensor roller. The control means can be switched between either of these inputs according to need.

The slight amount of tension carefully set in the workpiece upstream of the gapping station is just enough to keep the workpiece taut enough to work on it and guide it, but is not enough to cause the gaps that are formed in it to be of the wrong length.

The sensor system according to the invention has an incremental signal generator whose output can be analog or digital. This makes the system very easy to adjust for fasteners of different lengths.

It is also within the scope of this invention to provide means between the sensor and gapping means and connected to the controller for detecting marks on the workpiece and triggering operation of the gapper when same are detected. This is the arrangement discussed in detail in the above-mentioned copending and commonly assigned patent application.

The system can also incorporate means downstream of the gapper for detecting flaws in the workpiece. When a flaw is detected downstream machines, such as those that fit the end stops and slider to the workpiece, can be programmed to pass up the bad piece and thereby save parts.

In the looper according to this invention the biasing means can be nothing more than the weight of the buffer roller, or can be a weak spring.

DESCRIPTION OF THE DRAWING

The above and other objects, features, and advantages will become more readily apparent from the following, reference being made to the accompanying drawing in which.

SPECIFIC DESCRIPTION

Figure 3:
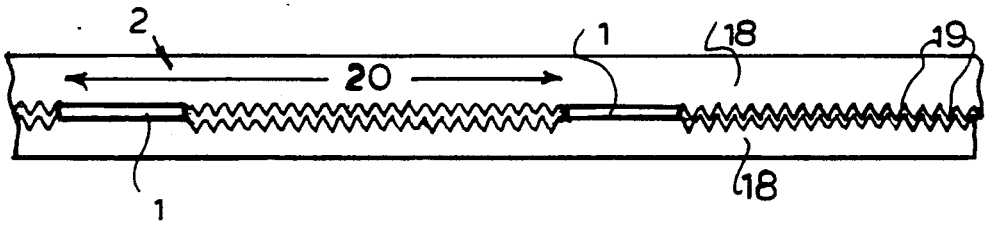
FIG. 3 is a top view showing the workpiece created by the system of this invention.

As seen in FIG. 3 a slide-fastener workpiece 2 is formed of a pair of textile tapes 18 having confronting edges provided with interleaved coil-type coupling elements 19. According to this invention the elements 19 are cut out at gaps 1 at longitudinal spacings 20. These gaps 1 serve for mounting of the end stops and slider and can even be detected by downstream machines to trigger the installation of these parts as well as the longitudinal subdivision of the workpiece 2 into fastener-length pieces.

Figure 1:
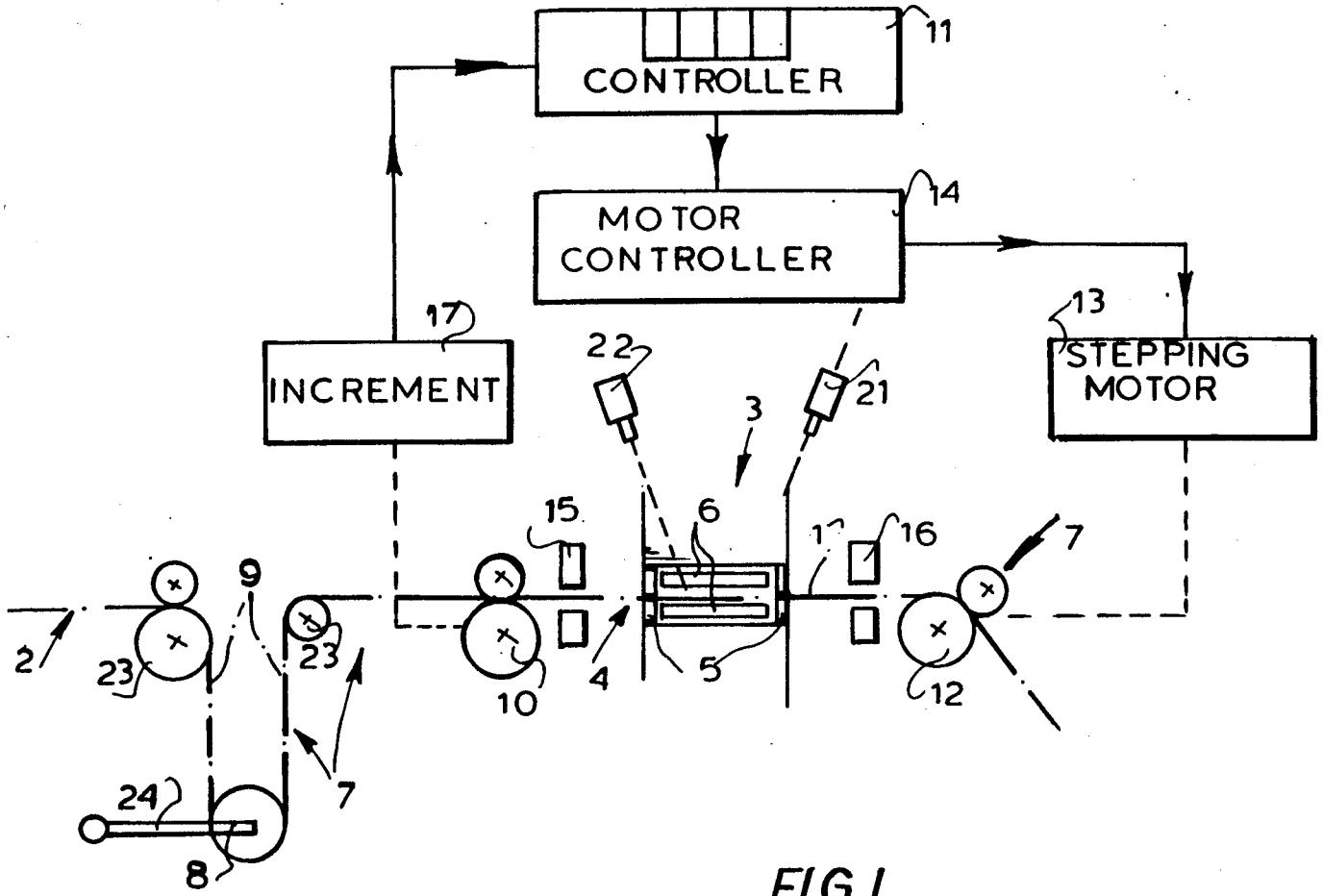
FIG. 1 is a mainly diagrammatic side view illustrating the system of this invention.
Figure 2:
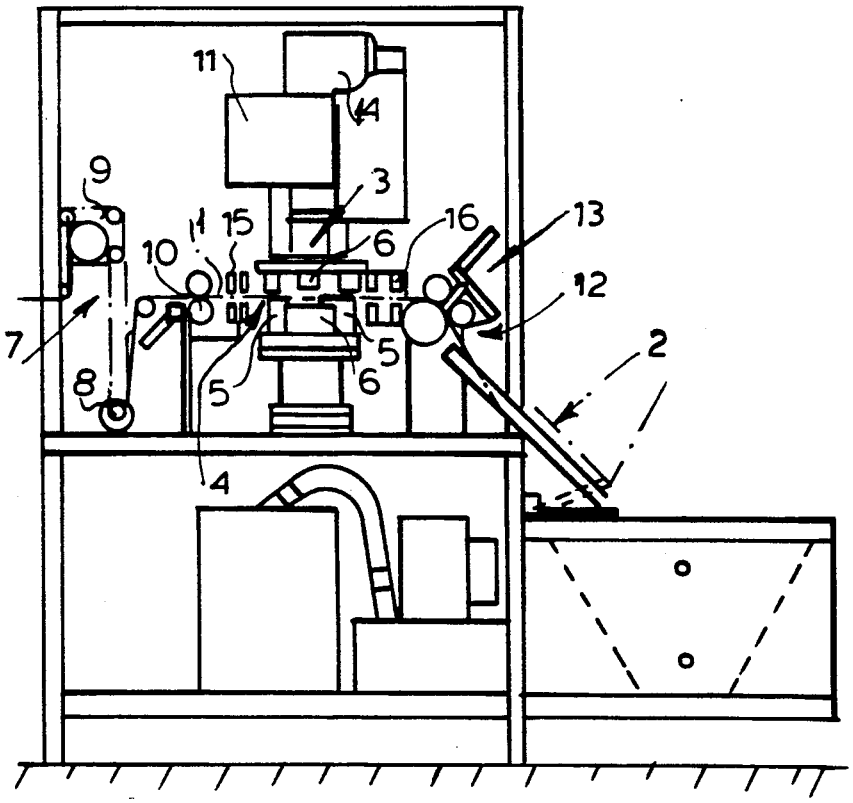
FIG. 2 is a side view of the gapping machine.

These gaps 1 are formed as seen in FIGS. 1 and 2 in a gapping machine 3 forming a longitudinal guide 4 for the workpiece 2 and provided with longitudinally spaced clamps 5 flanking a cutter 6. Respective actuators 21 and 22 control the clamps 5 and cutter 6. Immediately downstream of the gapping machine 3 is a pair of pinch rollers 12 that engage the workpiece 2 very tightly, that is so it is virtually impossible for it to slip between them. These rollers 12 are operated by a stepping motor 13 operated by a controller 14.

Upstream of the gapping machine 3 is a looper 7 comprised of a central downwardly biased looping roll 8 between a pair of upper buffer rollers 23 and 27, the latter of which is driven by a motor 30. The looping roller 8 is carried on an arm 24 so that it can move up and down fairly readily. It is so light that it imparts a stretch of no more than 0.5% to the workpiece 2, that is the workpiece 2 is tensioned so that its length exceeds its length when not tensioned at all by at most 0.5%. The vertical stroke of this roller 8 is substantially more than half the length 20. The arm 24 is carried on a potentiometer 25 that provides an output indicating roller position. This output is fed to a controller 26 that in turn operates the drive motor 30 for the roller 27 to maintain the desired tension in the workpiece 2 upstream of the gapping machine 3.

Between the looper 7 and the gapping machine 3 are a pair of tight sensor rollers 10 and 31 pinching the workpiece 2 tightly and connected to via respective incremental sensor 17 and 28 that feed an actual-value output via an SPDT switch 29 to a controller 11 that itself generates a desired-value signal and compares it to this actual-value output. The roller 10 engages the tapes 18 so that its output corresponds to tape length and the roller 31 is toothed and its teeth engage between the turns of the elements 19 so that its output corresponds to coupling-element length. The controller 11 in turn is connected to the actuators 21 and 22 and is connected via a motor controller 14 to the stepping motor 13 to start and stop the rotation of the rolls 12.

Thus according to this invention after a gap 1 is formed and the clamps 5 open the drive 12 is started and is operated until the rollers 10 determine that the workpiece 2 has been fed the distance 20 through the guide 4, this being ascertained by comparison in the controller 11 of the actual value from the sensor system 10, 17 or 28 and its internal set point. Then the rollers !2 are arrested and simultaneously the clamps 5 are closed to arrest the workpiece 2. While the workpiece is arrested the looper roller 8 moves downward so that, even if the workpiece 2 continues to be fed into the machine, the excess can be taken up by this looper 7. Nonetheless the controller 26 ensures that the workpiece will not get completely slack by stopping infeed if the roller 8 is in its bottommost position.

We claim:

1. An apparatus for forming longitudinally spaced gaps in a workpiece formed of a pair of longitudinally extending parallel tapes having confronting edges provided with longitudinally extending and transversely couplable coupling elements, the apparatus comprising:

transport means including a stepping motor connected to at least one feed roller, the feed roller operatively engaging the workpiece upstream of the gapping station without slip for pulling the workpiece longitudinally through the gapping station;

storage means upstream of the feed roller and upstream of the gapping station for looping the workpiece upstream of the gapping station in a variable-size loop and including a rotatable and movable buffer roller over which the workpiece passes, a pair of rotatable but nonmoving buffer rollers flanking the movable buffer roller, the loop being formed around the movable buffer roller, biasing means urging the movable buffer roller away from the flanking rollers with a force sufficient to tension the workpiece, means for providing an output corresponding to the position of the movable buffer roller relative to the nonmoving buffer rollers, and tension control means for operating the transport means in accordance with the output for stretching the workpiece between the movable and nonmovable buffer rollers by at most 1%;

gapping means at the gapping station for periodically clamping and longitudinally arresting the workpiece and cutting the coupling elements therefrom to form a gap in the workpiece;

sensor means including at least one sensor roller physically engaging the workpiece between the gapping station and the loop for detecting and measuring displacement of the workpiece after each clamping and cutting of the workpiece at the gapping station and for generating an actual-value output corresponding to the displacement of the workpiece; and displacement control means connected to the sensor means for comparing the actual-value output with a set point corresponding to a desired slide fastener length after each clamping and connected to the gapping means and the transport means for longitudinally advancing the workpiece after each cutting and clamping of the workpiece only until the actual-value output matches the set point.

2. The apparatus defined in claim 1 wherein the sensor means includes an incremental signal generator.

3. The apparatus defined in claim 1 wherein the transport means includes a pair of such feed rollers pinching the workpiece without the possibility of substantial slippage between the pair of feed rollers and the workpiece.

4. The apparatus defined in claim 1, further comprising means downstream of the gapping means for detecting flaws in the workpiece.

5. The apparatus defined in claim 1 wherein the control means is adjustable as regards the set point, whereby different fastener lengths can be set in the control means.

6. The apparatus defined in claim 1 wherein the means for providing the output of buffer-roller position is a potentiometer.

7. The apparatus defined in claim 1 wherein the sensor roller engages the tapes and provides an output corresponding to the length of tape passing the sensor roller.

8. The apparatus defined in claim 1 wherein the sensor roller is toothed and engages at least one of the coupling elements to provide an output corresponding to the length of the at least one coupling element passing the sensor roller.

* * * * *